US006570432B2

(12) United States Patent
Denison

(10) Patent No.: US 6,570,432 B2
(45) Date of Patent: May 27, 2003

(54) INTEGRATOR TOPOLOGY FOR CONTINUOUS INTEGRATION

(75) Inventor: Timothy J. Denison, Andover, MA (US)

(73) Assignee: President and Fellows of Harvard College, Cambridge, MA (US)

( * ) Notice: Subject to any disclaimer, the term of this patent is extended or adjusted under 35 U.S.C. 154(b) by 0 days.

(21) Appl. No.: 10/133,682

(22) Filed: Apr. 26, 2002

(65) Prior Publication Data

US 2002/0149413 A1 Oct. 17, 2002

Related U.S. Application Data

(62) Division of application No. 09/502,134, filed on Feb. 11, 2000, now Pat. No. 6,380,790.

(51) Int. Cl.[7] ..... G06G 7/19
(52) U.S. Cl. ..... 327/344; 327/345
(58) Field of Search ..... 327/336, 337, 327/344, 345

(56) References Cited

U.S. PATENT DOCUMENTS

| | | | | |
|---|---|---|---|---|
| 4,727,330 A | | 2/1988 | Funk | |
| 4,764,752 A | | 8/1988 | Ormond | |
| 4,816,745 A | | 3/1989 | Schneider | |
| 4,837,527 A | | 6/1989 | Sauer | |
| 5,083,091 A | | 1/1992 | Frick et al. | |
| 5,113,085 A | | 5/1992 | Schäfer et al. | |
| 5,363,055 A | * | 11/1994 | Ribner | 327/337 |
| 5,550,498 A | | 8/1996 | Kwan et al. | |
| 5,812,023 A | * | 9/1998 | Jones | 327/337 |
| 5,977,803 A | * | 11/1999 | Tsugai | 327/337 |
| 6,084,450 A | | 7/2000 | Smith et al. | |
| 6,194,946 B1 | * | 2/2001 | Fowers | 327/337 |

OTHER PUBLICATIONS

Enz et al., "Circuit Techniques for Reducing the Effects of Op–Amp Imperfections: Autozeroing, Correlated Double Sampling, and Chopper Stabilization," *Proceedings of the IEEE*, vol. 84, No. 11, pp. 1584–1614, Nov. 1996.

Sigworth, "Electronic Design of the Patch Clamp," Chapter 1, pp. 3–34, in *Single–Channel Recording*, 2nd Edition, Sakmann and Neher, Editors, Plenum Press, New York, New York, 1995.

Denison et al., "A New Integrating Patch Clamp Amplifier Eliminates Discontinuous 'Resets'," Abstracts of the Biophysical Society 44th Annual Meeting, *Biophysical Journal*, vol. 78, No. 1, Part 2 of 2, p. 267A, Jan. 2000.

* cited by examiner

*Primary Examiner*—Kenneth B. Wells
(74) *Attorney, Agent, or Firm*—Theresa A. Lober

(57) ABSTRACT

Provided are integrator circuit topologies that enable continuous integration without reset of the integrator circuit. One such integrator circuit includes a first integrator and a second integrator, each of the two integrators having a non-inverting terminal. Each of the non-inverting terminals is connected to an input node to alternately receive an input current for continuous integrator circuit integration without integrator circuit reset. The inverting terminal of the second integrator can be connected to an inverting terminal of the first integrator. The non-inverting terminal of the second integrator can be connected to an output of the first integrator through a first capacitor, and an output of the second integrator can be connected to a non-inverting terminal of the first integrator through a second capacitor. With such a capacitor connection, the capacitors alternately charge and discharge, based on integrator input current that is alternately directed between the non-inverting terminals of the integrators.

17 Claims, 17 Drawing Sheets

INTEGRATOR TOPOLOGY FOR CONTINUOUS INTEGRATION

CROSS REFERENCE TO RELATED APPLICATIONS

This application is a divisional of copending U.S. application Ser. No. 09/502,134, filed Feb. 11, 2000, now issued as U.S. Pat. No. 6,380,790.

GOVERNMENT SUPPORT

This invention was made with Government support under Contract No. N65236-98-1-5407, awarded by DARPA. The Government has certain rights in the invention.

BACKGROUND OF THE INVENTION

This invention relates to integrators.

Integrators have high linearity, wide bandwidth, and low noise characteristics. Integrators, however, require a reset interval to discharge the capacitor in the integrator's feedback loop which results in significant "dead" times in measurements and harmful transients on the integrator's input. Additionally, the rapid discharge interval aggravates the problem of dielectric absorption, thereby undermining the lower limit of instrument precision.

Referring to FIG. 1, an integrator 10 includes a feedback loop having a switch 12 in parallel with a feedback capacitor 14. The switch 12 allows the feedback capacitor 14 to discharge when the switch 12 is closed. Placing one or more strings of series resistors and capacitors in parallel with the feedback capacitor 14 with or without the switch 12 reduces at least some of the harmful effects of this discharge. However, even in some arrangements having multiple capacitors, dielectric absorption is still a problem since the charge in the series capacitors is redistributed with the feedback capacitor 14.

SUMMARY OF THE INVENTION

The invention overcomes these unwanted effects of integrator reset by providing integrator circuit topologies that enable continuous integration, without the need for reset of the integrator circuit. One such integrator circuit includes a first integrator and a second integrator, each of the two integrators having a non-inverting terminal. Each of the non-inverting terminals is connected to an input node to alternately receive an input current for continuous integrator circuit integration without integrator circuit reset.

In further configurations, the inverting terminal of the second integrator can be connected to an inverting terminal of the first integrator. The non-inverting terminal of the second integrator can be connected to an output of the first integrator through a first capacitor, and the output of the second integrator can be connected to the non-inverting terminal of the first integrator through a second capacitor. In operation, the first integrator and the second integrator have voltages on respective ones of the inverting and non-inverting terminals that are substantially equal, and the two integrators produce output voltages that are complementary.

In a further integrator circuit provided by the invention, at least one integrator is provided, having an input for receiving an input current. A plurality of integrator feedback capacitors are provided, with each capacitor being connected to alternately charge and discharge, based on the integrator input current. This cooperative charging and discharging enables continuous integrator circuit integration without integrator circuit reset.

These integrator circuit topologies can be employed in a wide variety of applications in which low signal level, precise measurements are required. For example, in one biological application, the first integrator and the second integrator can be operated to each introduce an output voltage into a chemical bath on either side of a biological membrane. In this application, the integrator circuit is configured to detect fluctuations of ion channels. In another application, e.g., the integrator circuit can be configured for charge detection.

These applications are particularly well-served by the integrator circuit of the invention in its elimination of a need for rapid discharging of feedback capacitors during operation. The integrator circuit of the invention can perpetually integrate incoming current signals, such as low-level transducer signals, to produce an output of a continuous flow of two complementary voltages. This perpetual integration eliminates "dead time" and input transients, compensates for charge injection at the integrator input, and reduces the harmful effects of dielectric absorption. At the same time, the integrator circuit maintains a high degree of operational linearity, produces a low level of noise, and can accommodate a wide bandwidth of input signals.

Other features and advantages of the invention are provided in the following detailed description and the accompanying drawings, and in the claims.

DETAILED DESCRIPTION

Figure 1:
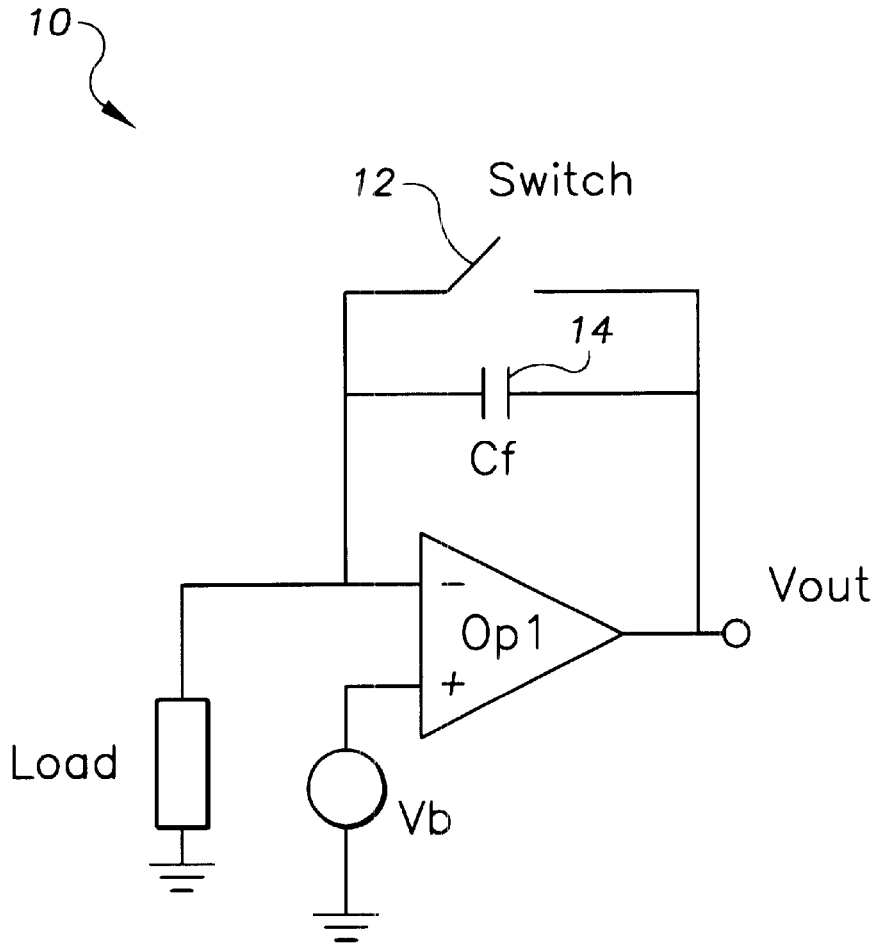
FIG. 1 PRIOR ART
FIG. 1 is a schematic diagram of a conventional integrator.
Figure 2:
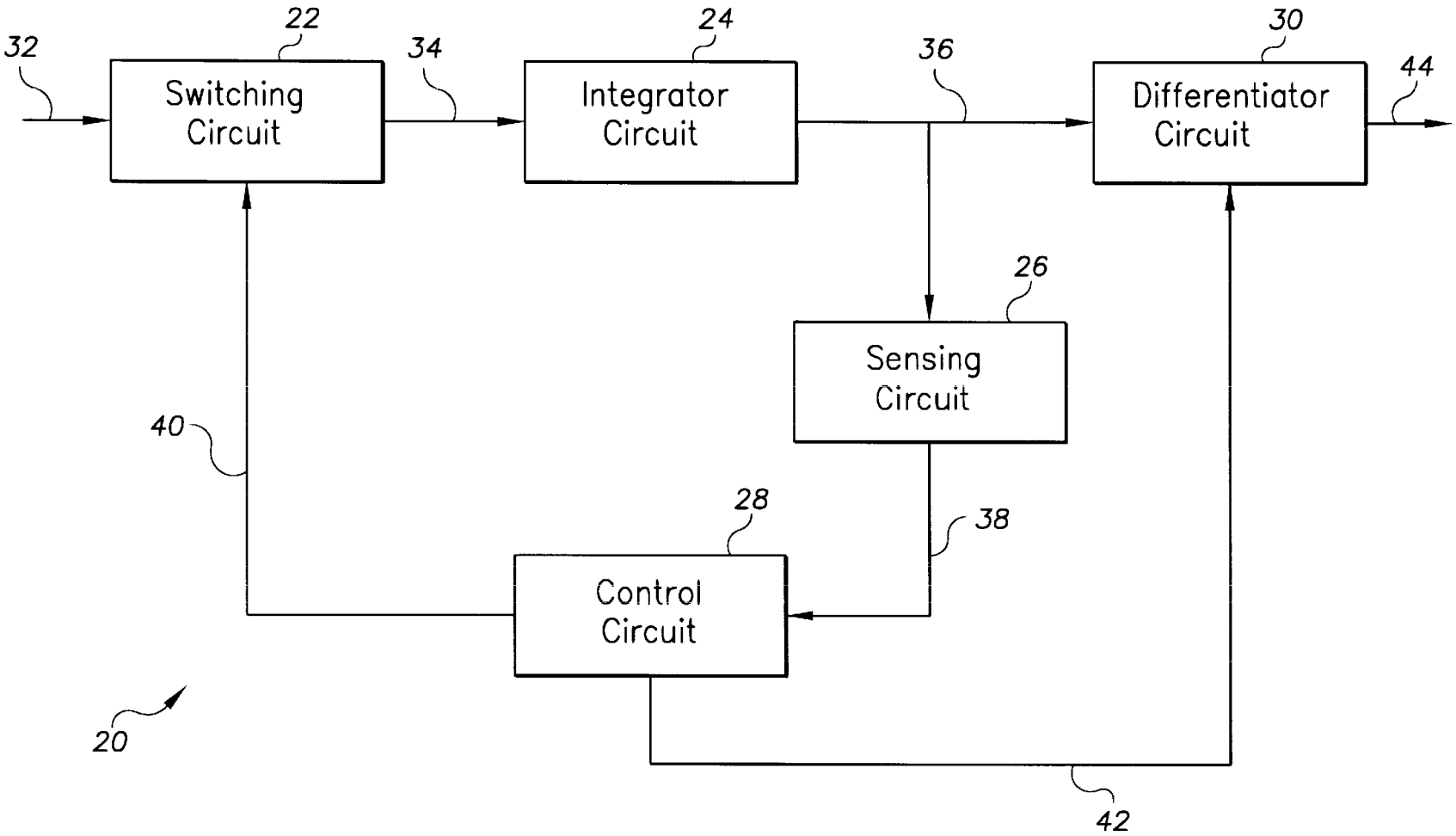
FIG. 2 is a block diagram of a chopper stabilizing circuit.

Referring to FIG. 2, a chopper stabilizing circuit 20 includes a switching circuit 22, an integrator circuit 24, a sensing circuit 26, a control circuit 28, and a differentiator circuit 30. In general, the chopper stabilizing circuit 20 has a topology and is controlled in a manner that eliminates the need for rapid discharging of feedback capacitors in the integrator circuit 24. In particular, and as will be discussed in greater detail below, this advantage is accomplished by alternating the signal current from the switching circuit 22 to the integrator circuit 24. In this way, the integrator circuit 24 can perpetually integrate these incoming current signals (low-level transducer signals) and output a continuous flow of two complementary voltages. The sensing circuit 26 detects when one of the complementary voltages reaches a threshold value and notifies the control circuit 28. The control circuit 28 responds by sending a signal to the switching circuit 22. This signal changes the position of switches in the switching circuit 22, thereby alternating the signal current to the integrator circuit 24. The differentiator circuit 30 receives the complementary voltages output by the integrator circuit 24 and provides a demodulated differentiation bit stream representing the slope of the complementary voltages. As will be described in more detail below, this chopper stabilizing circuit 20 eliminates dead time and input transients, compensates for charge injection at the input, and reduces the harmful effects of dielectric absorption. At the same time, the chopper stabilizing circuit 20 maintains high linearity, low noise, and wide bandwidth.

In the layout of the chopper stabilizing circuit 20, the switching circuit 22 has an input at a first node 32 for receiving an input signal. The input signal includes the driving current/voltage for the chopper stabilizing circuit 20 from a load, a current source, and/or a voltage source. The switching circuit 22 has an output at a second node 34 that is determined by the position of the switch(es) included in the switching circuit 22. The integrator circuit 24 has an input at the second node 34 for receiving an input signal from the switching circuit 22 and an output at a third node 36. The sensing circuit 26 has an input at the third node 36 for receiving an input signal from the integrator circuit 24 and an output at a fourth node 38. The control circuit 28 has an input at the fourth node 38 for receiving an input signal from the sensing circuit 26 and output at a fifth node 40 and a sixth node 42. The switching circuit 22 has an input for receiving an input signal from the control circuit 28 at the fifth node 40. This input signal controls the position of the switch(es) in the switching circuit 22.

The differentiator 30 is shown in FIG. 2, though its presence is not necessary to ensure proper functioning of the chopper stabilizing circuit 20. If it is not present, the integrator circuit 24 and the control circuit 28 may not necessarily have outputs at the third node 36 and the sixth node 42, respectively. The differentiator circuit 30 has an input at the third node 36 for receiving an input signal from the integrator circuit 24 and at the sixth node 42 for receiving an input signal from the control circuit 28. The input signal at the sixth node 42 controls the switch(es) included in the differentiator circuit 30. The differentiator also has an output at a seventh node 44.

Figures 1, 3:
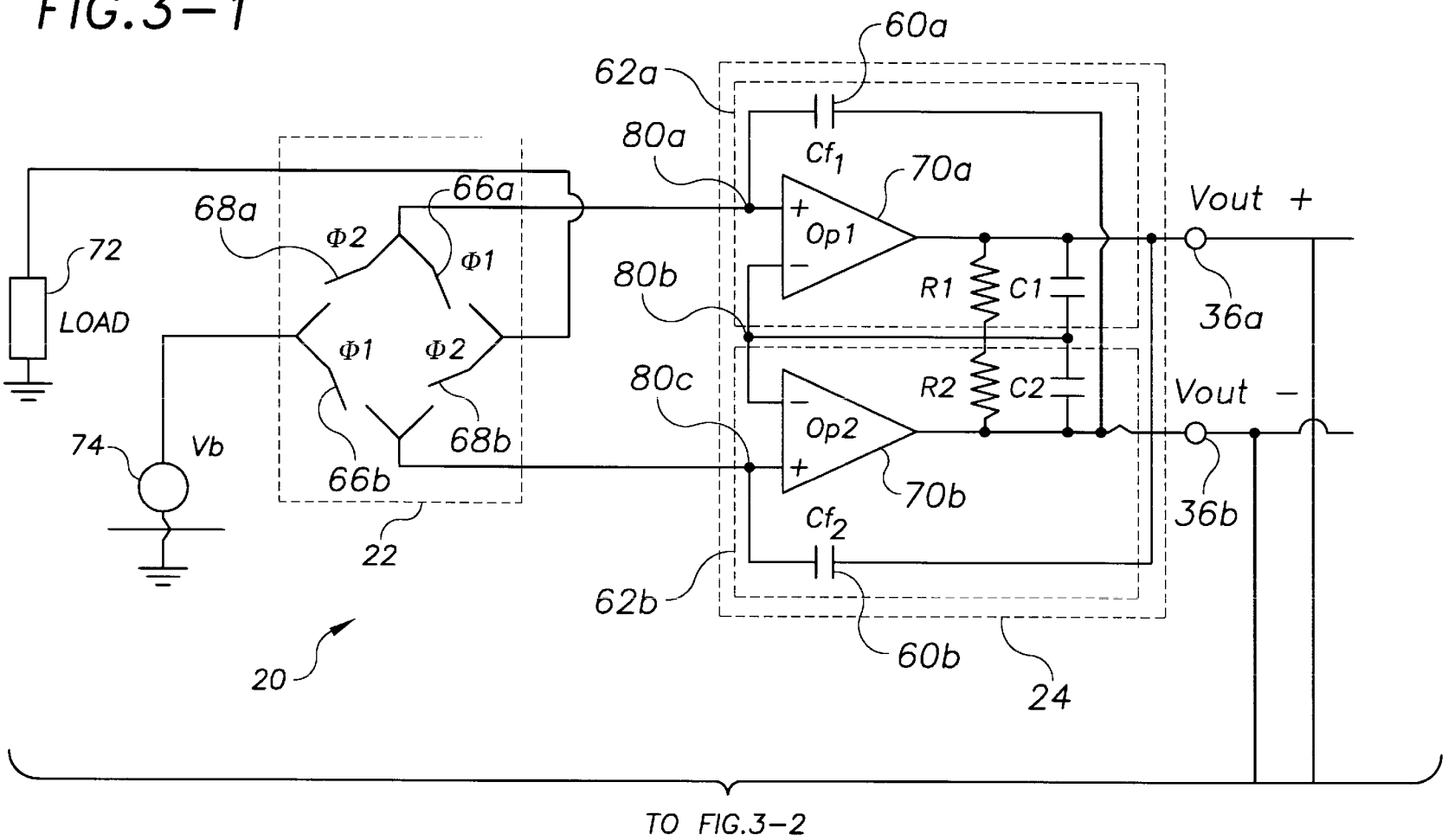
FIG. 3 is a schematic diagram of the block diagram of FIG. 2.
Figures 2, 3:
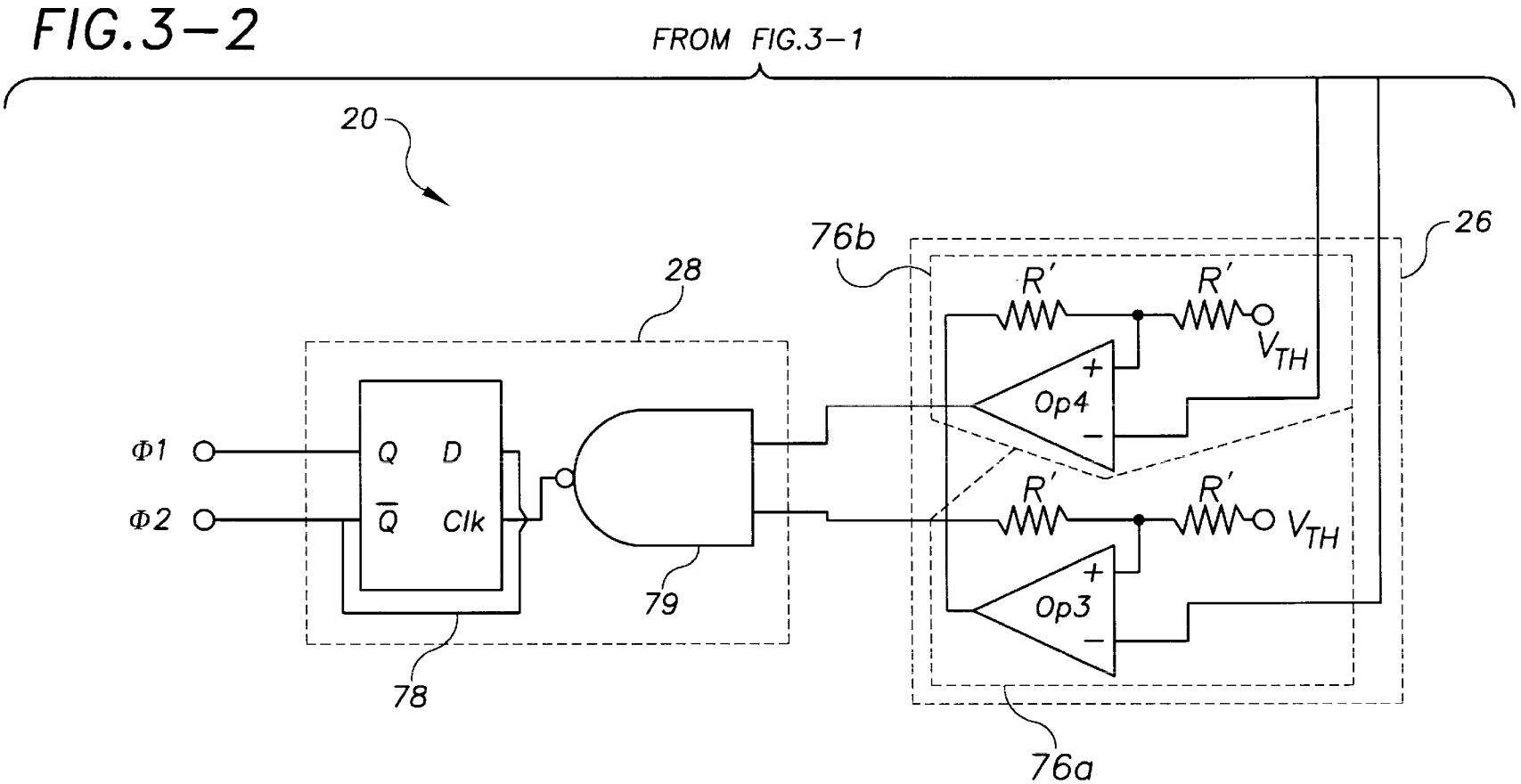

Referring to FIG. 3, one particular embodiment of a chopper stabilizing circuit 20 includes a switching circuit 22, an integrator circuit 24, a sensing circuit 26, and a control circuit 28. The chopper stabilizing circuit 20 eliminates the need for rapid discharging of feedback capacitors 60*a–b* (preferably Teflon®) in the integrator circuit 24 by alternating the signal current from the switching circuit 22 to two integrators 62*a–b* included in the integrator circuit 24. In this way, one feedback capacitor discharges while the other charges, thereby providing two inversely related output voltages (Vout+, Vout−) at Vout nodes 36*a–b*. Once either of the output voltages reaches a predetermined threshold value (Vth), a regenerative comparator 76*a–b* included in the sensing circuit 26 and connected to this output voltage is tripped. Hysteresis prevents the sensing circuit 26 from causing false resets. The comparator 76*a–b* triggers a D-type flip-flop 78 through a NAND gate 79, both included in the control circuit 28. As the flip-flop 78 changes state, the outputs Q and Q-bar connected to the switches 66*a–b*, 68*a–b* cause them to reverse position. This reversal preserves the same orientation with respect to the load 72, maintaining a uniform bias, while alternating the signal current to the integrator circuit 24.

More specifically, the switching circuit 22 includes two pairs of two symmetric switches 66*a–b*, 68*a–b*. The switches 66*a–b*, 68*a–b* may be any type of standard MOS (metal oxide semiconductor) switch, e.g., MAXIM 326. Only one set of switches 66*a–b*, 68*a–b* is closed at a time, each closed switch providing a path for a signal to the non-inverting input terminal of an operational amplifier (opamp) 70*a–b*, e.g., Burr-Brown OP627, included in the integrators 62*a–b*. When the phase one (>1) switches 66*a–b* are closed, a load 72 provides the input current (Io) to the first opamp 70*a* while a voltage source 74 provides the bias voltage (Vb) to the second opamp 70*b*. When the phase two (>2) switches are closed, the load 72 and the voltage source 74 provide current/voltage to the other opamp 70*a–b*. The values of Vout+ at the Vout node 36*a* and Vout− at the Vout node 36*b* depend on the position of these switches 66*a–b*, 68*a–b*.

Figure 4:
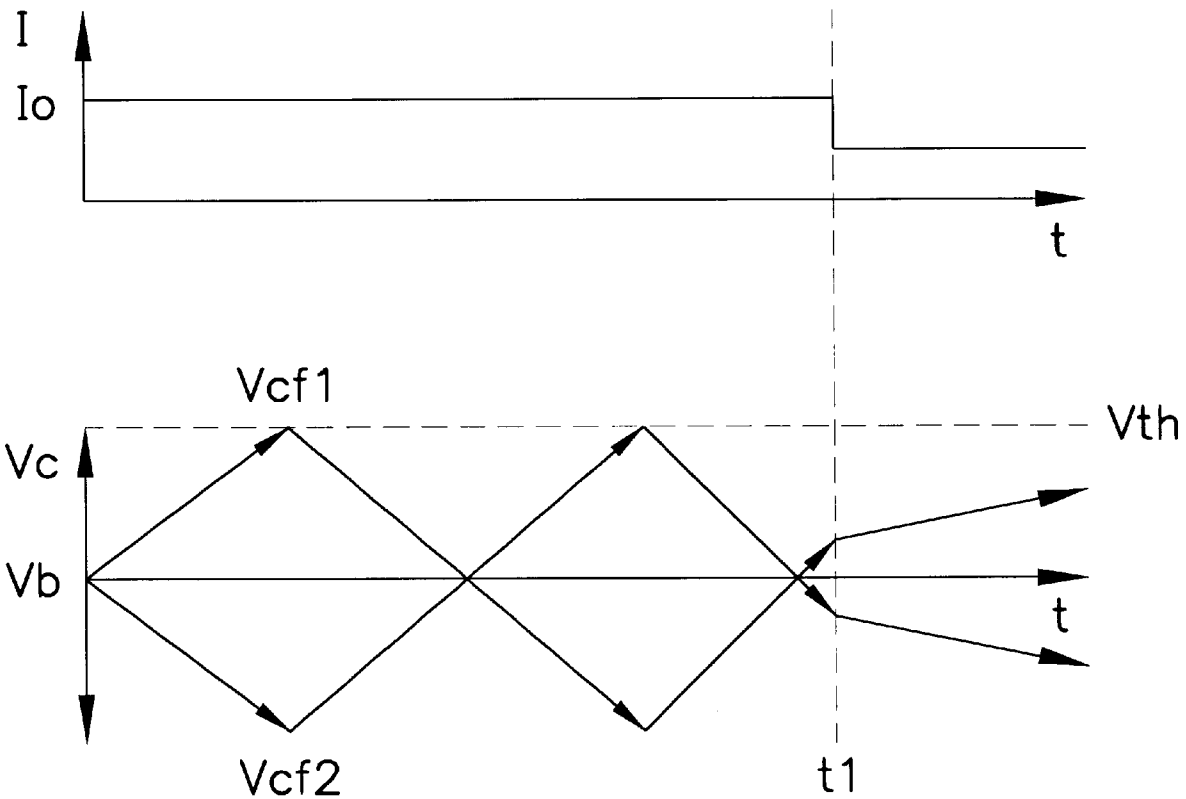
FIG. 4 is a graph showing the output of the integrator circuit of FIG. 3.

FIG. 4 shows the inverse relationship between Vout+ (Vcf2) and Vout− (Vcf1). In this scenario, the >2 switches 68*a–b* begin closed and the feedback capacitors 60*a–b* initially are discharged, so Vout+ and Vout− begin at Vb. When Io flows through the load 72, Vout+ and Vout− alternately and inversely ramp up and down in accordance with:

$$\frac{dV}{dt} = \frac{Io}{Cf}.$$

When Io decreases at a time t1, this relationship ceases.

The integrator circuit 24 can effectively integrate forever (constantly flowing Io), with negligible glitching during phase switching. This lack of glitch is helped by the symmetry of input stage of the integrator circuit 24. Every input stage node 80*a–c* sees one switch 66*a–b*, 68*a–b* turn on and another turn off during a phase transition. The already low charge injection of the switches 66*a–b*, 68*a–b* is then effectively reduced to tens of femtoCoulombs (fC). Additionally, the symmetric pair requires no voltage drop across a switch 66*a–b*, 68*a–b*, aiding in keeping leakage currents below a picoAmp (pA). The voltages at the input stage nodes 80*a–c* are substantially the same.

Figure 5:
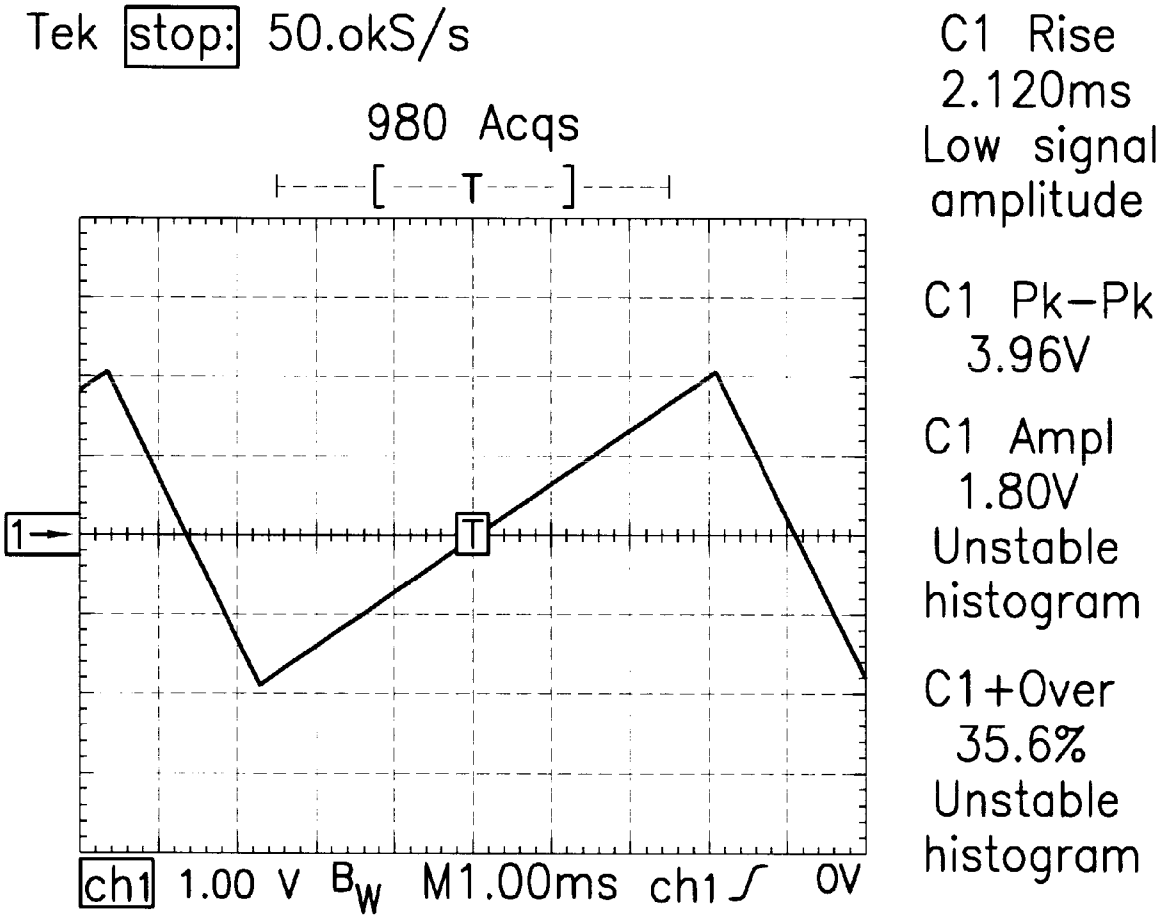
FIGS. 5–6 are graphs showing the chopper stabilization of the integrator circuit of FIG. 3.
Figure 6:
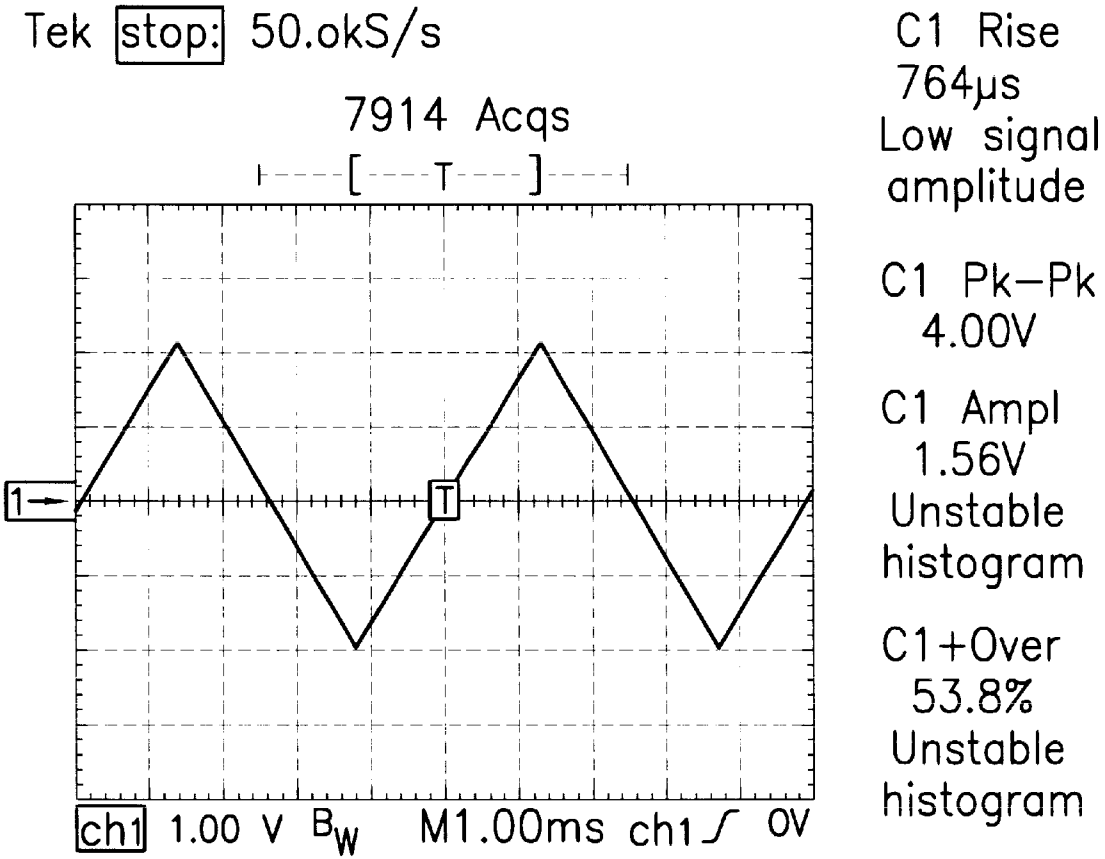

Referring to FIGS. 5 and 6, it is appreciated that offset may be a problem as in FIG. 5, but techniques exist to alleviate this problem, e.g., a stabilizing circuit. FIG. 5 shows the chop before stabilization, and FIG. 6 shows the chopper stabilization of the integrator circuit 24.

Figure 7:
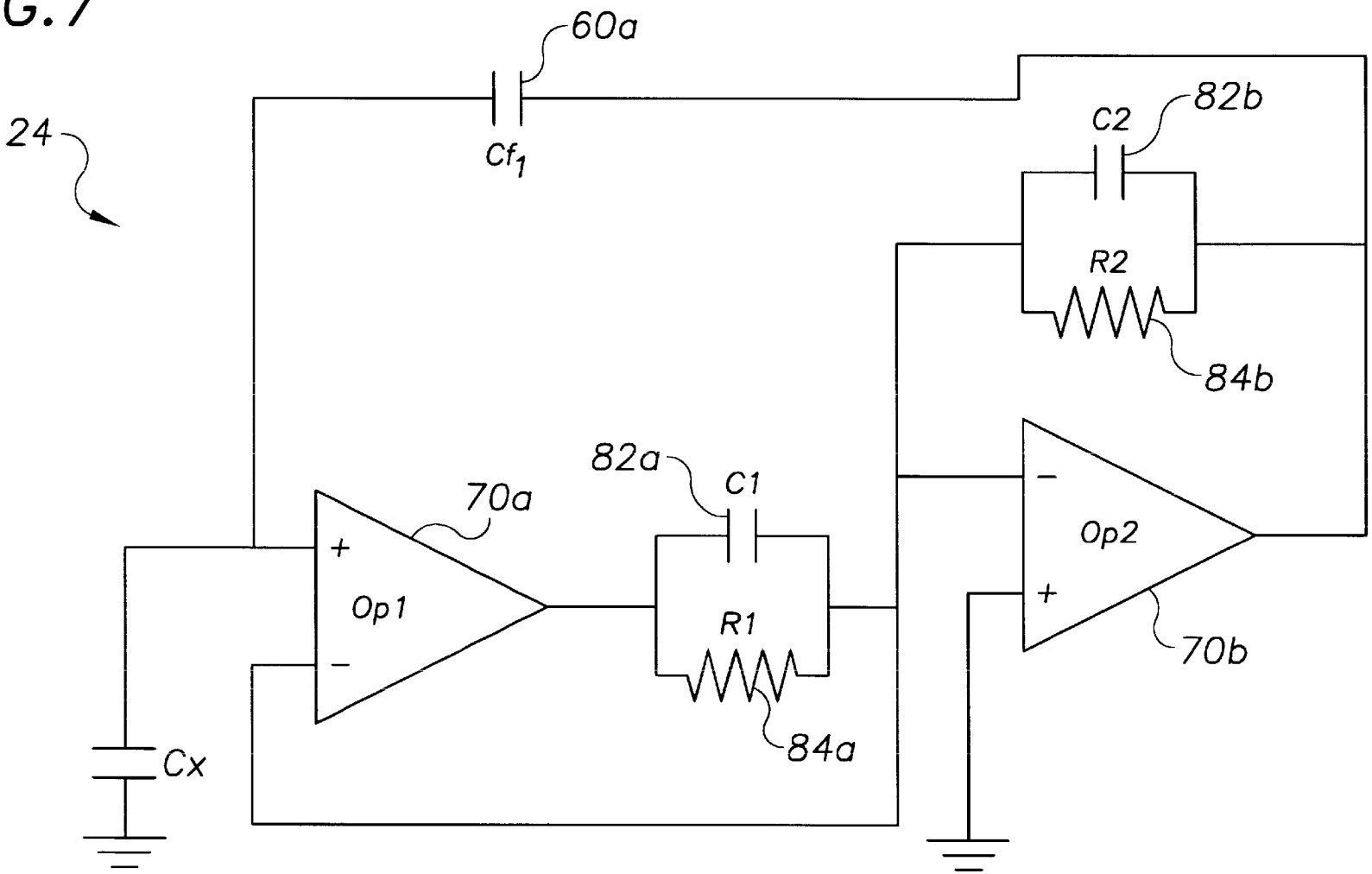
FIG. 7 is an unfolded view of the integrator circuit of FIG. 3.

Referring to FIG. 7, an unfolded view of the integrator circuit 24 helps demonstrate the manner in which the circuit functions. The compensation of the integrator circuit 24 may be broken down into two sections: minor and major loops. The minor loop concerns the stability of each opamp 70*a–b*; the major loop comprises the total feedback loop around the integrator. The major loop encompasses a unity gain inverter with a voltage divider formed by the first feedback capacitor 60*a* reacting with the capacitance off the input stage of the first opamp 70*a*. The input capacitance is dominated by the opamp input capacitance and the parasitics of the switches 66*a–b*, 68*a–b*. The ratio of the capacitive voltage divider in this embodiment is approximately ten, which will keep the major loop crossover well below that of the minor loops. The minor loops are stabilized with the addition of shunt capacitances 82*a–b*, which help compensate for phase lag due to shunt resistors 84*a–b* (preferably metal film) reacting with the input capacitance of the opamps 70*a–b*. With the bandwidth of the opamps 70*a–b* on the order of 10 MHz in this embodiment, the chopper stabilizing circuit 20 should be able to track currents with a bandwidth of approximately 1 MHz.

Figure 8:
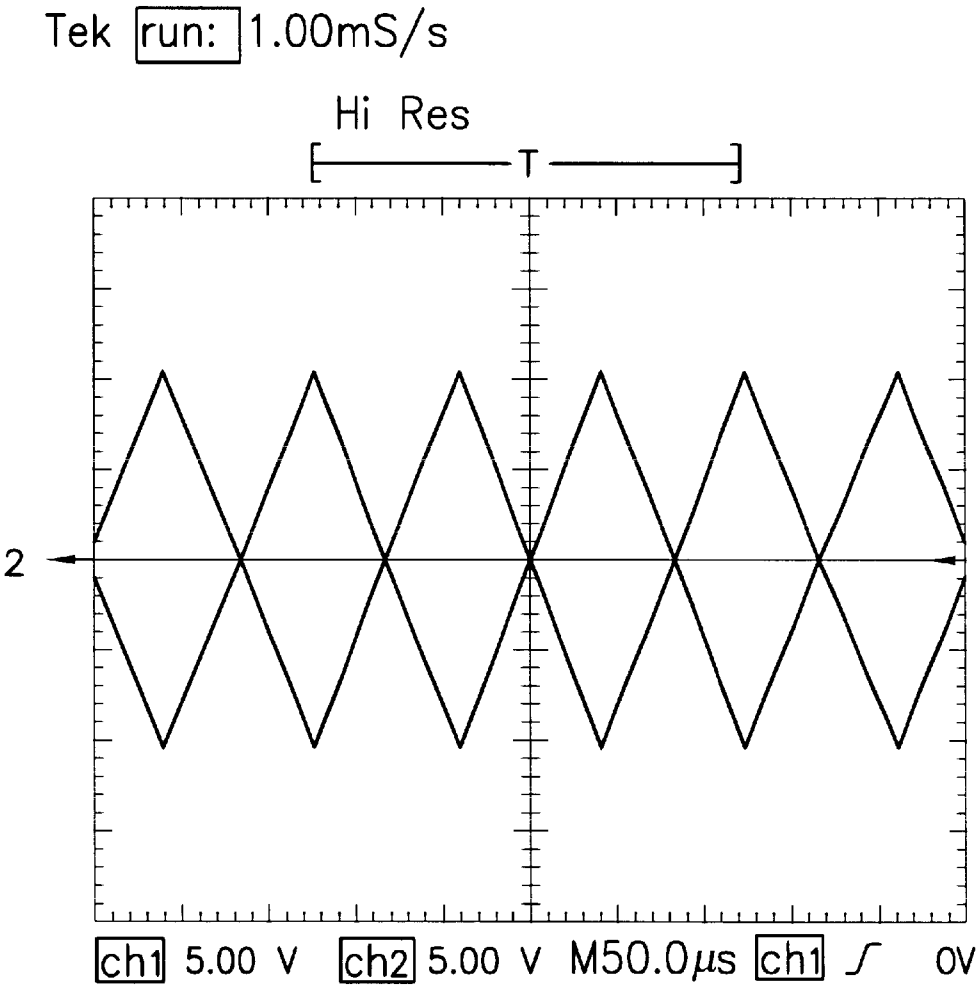
FIGS. 8–9 are graphs showing the output of the integrator circuit of FIG. 3.
Figure 9:
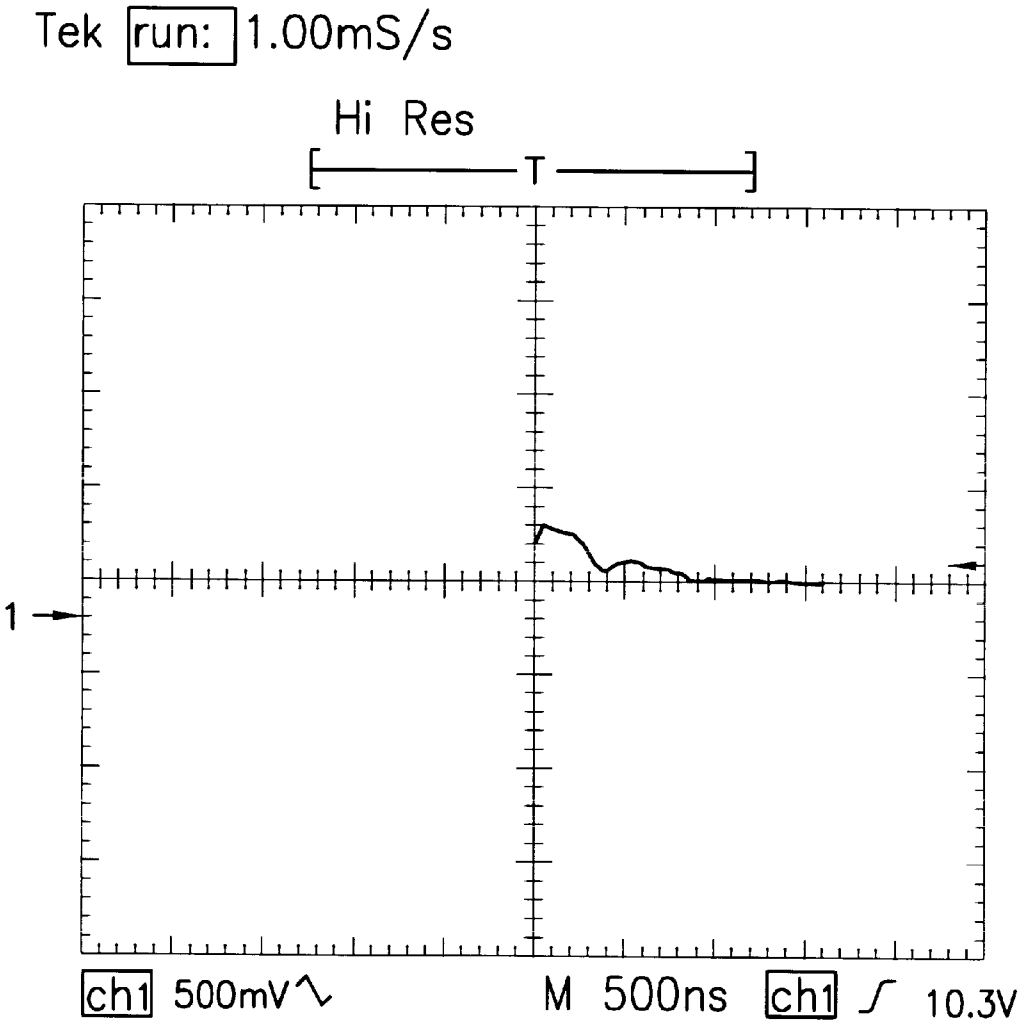
Figure 10:
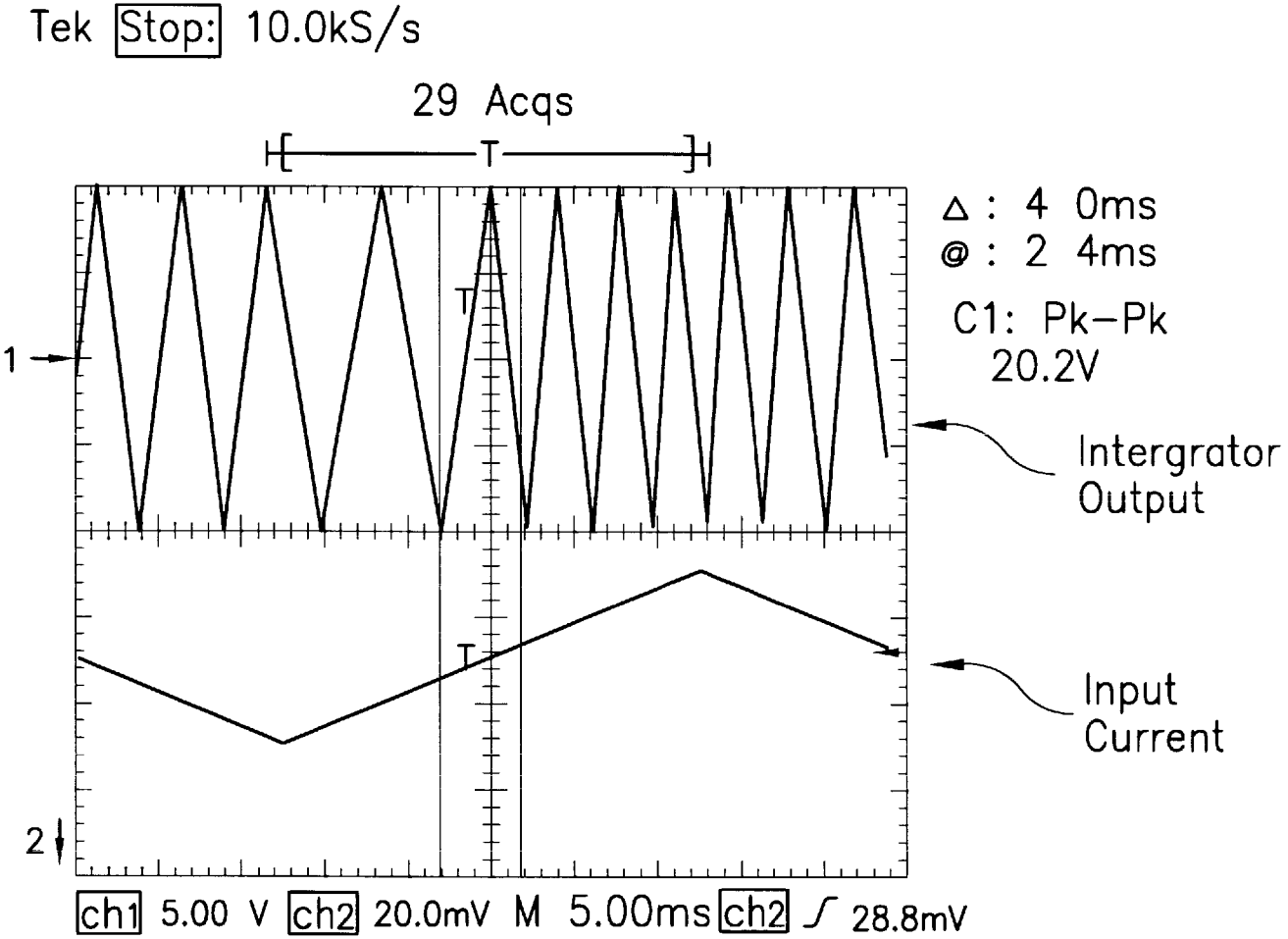
FIGS. 10–11 are graphs showing the response of the integrator of FIG. 3 to input current.
Figure 11:
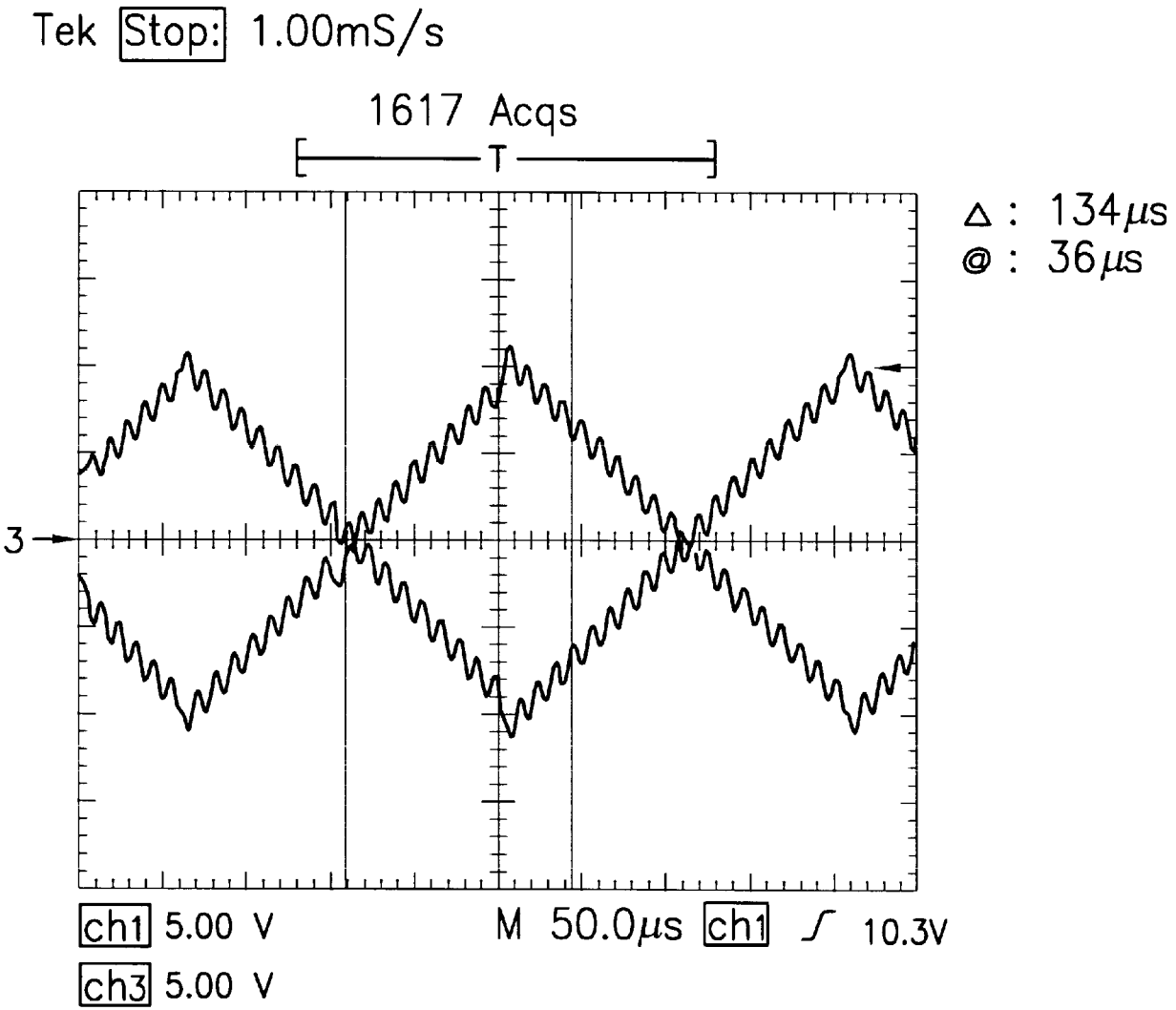
Figure 12:
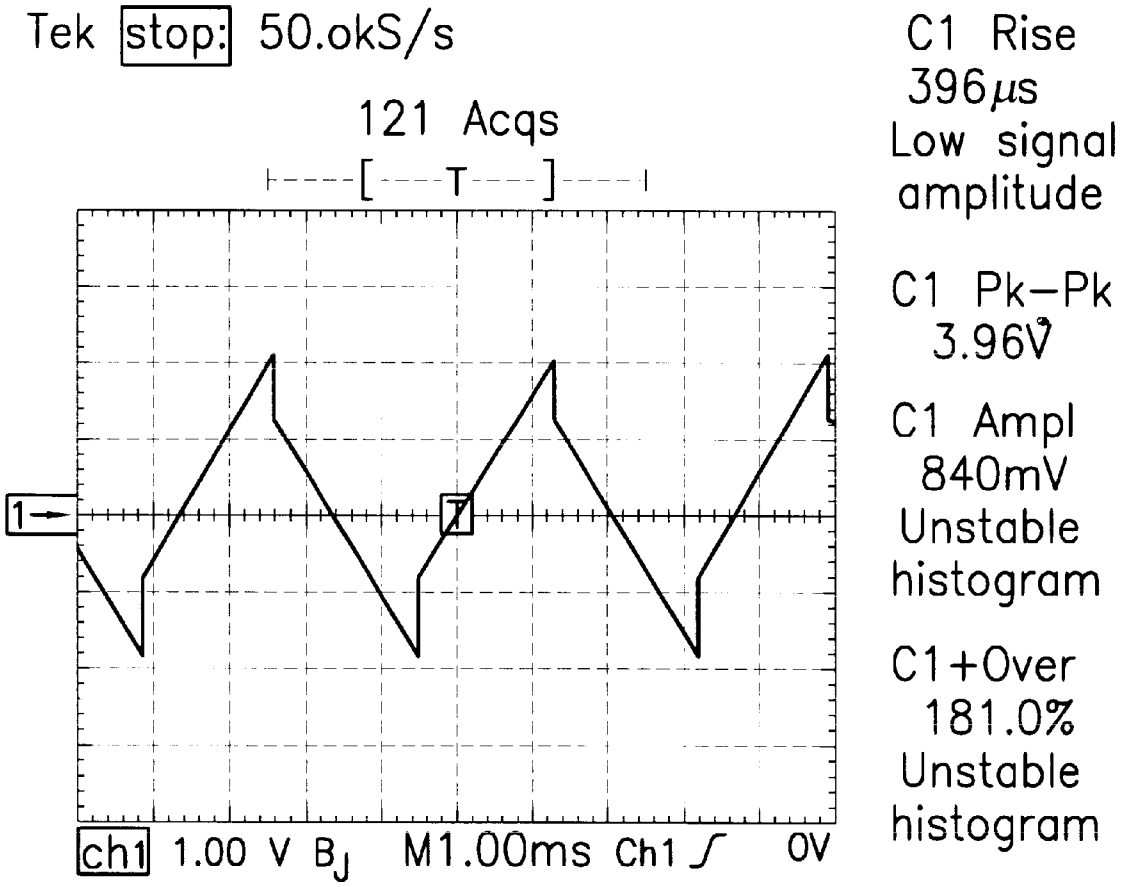
FIGS. 12–13 are graphs showing the charge injection compensation of the integrator circuit of FIG. 3.
Figure 13:
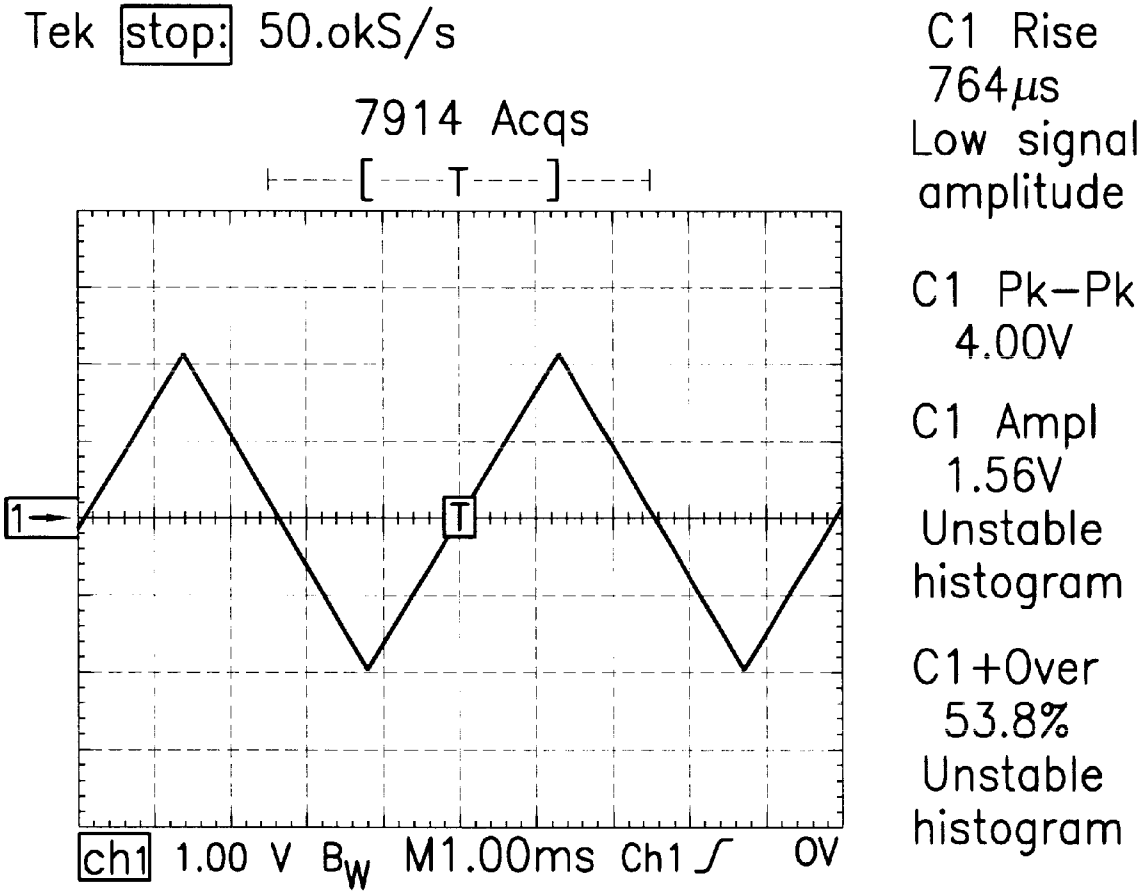

FIGS. 8–13 further demonstrate the functioning of the integrator circuit 24. FIG. 8 shows Vout+ and Vout− with 50 μs per horizontal division, the typical reset duration in standard integrators, e.g., Axopatch 200B and nuclear physics instrumentation. FIG. 9 shows a zoom in on the reset transient, with the switching occurring of the order of 500 ns, e.g., 700 ns. The 2 pF feedback capacitor 60*a–b* and a residual voltage jump of 20 mV signifies under 40 fC of charge injection. FIG. 10 shows the response of the integrator circuit 24 (top trace) to input current (bottom trace), a 2 nA peak-to-peak triangle wave. Because of this response, the integrator circuit 24 could be used for direct digitization of input current via single-slope integration by measuring the period between resets. FIG. 11 shows the response of the integrator circuit 24 in FIG. 10 superimposed with a 100 kHz sinusoid supplied by a 2 pF capacitor at the input. FIG. 12 shows the charge injection before compensation, and FIG. 13 shows the charge injection after compensation by the integrator circuit 24.

Figure 14:
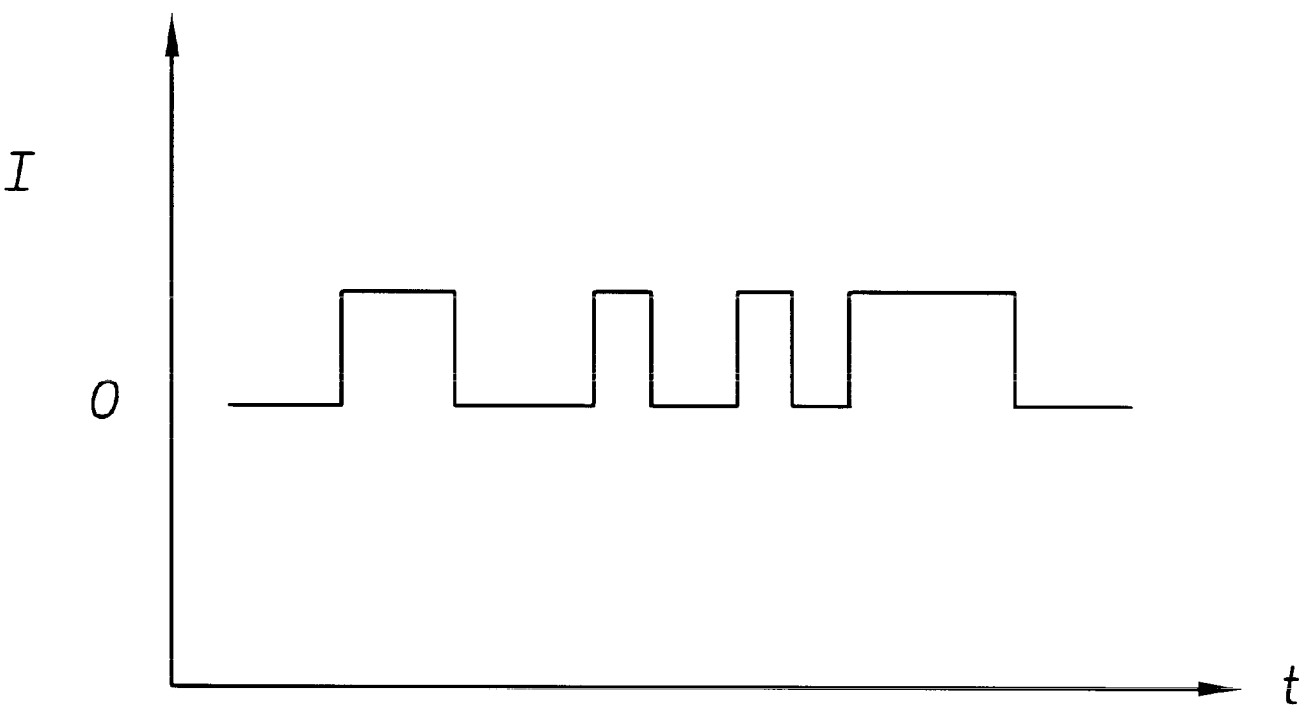
FIG. 14 is a graph showing currents detectable by the integrator circuit of FIG. 3.

Now referring to FIG. 14, the integrator circuit 24 can be used to detect the fluctuations of ion channels important in cell signaling and biological transport. These currents range from 0.1 pA to 100 pA, with bandwidths of 10 kHz. The integrator circuit 24 allows for measuring these currents without glitches from resetting.

Figure 15:
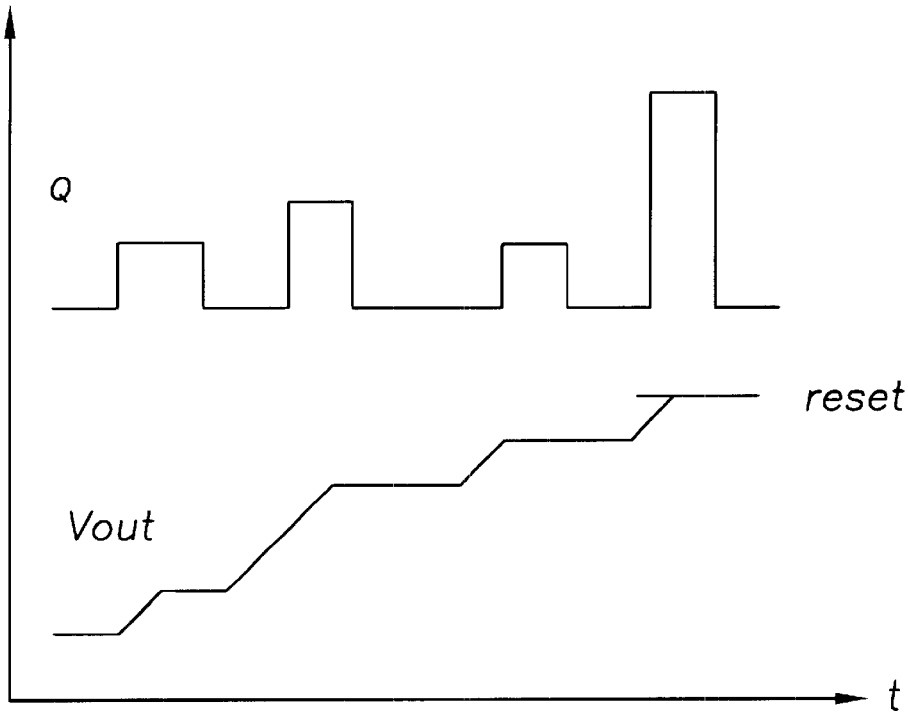
FIG. 15 is a graph showing charge detection by a conventional integrator circuit.
Figure 16:
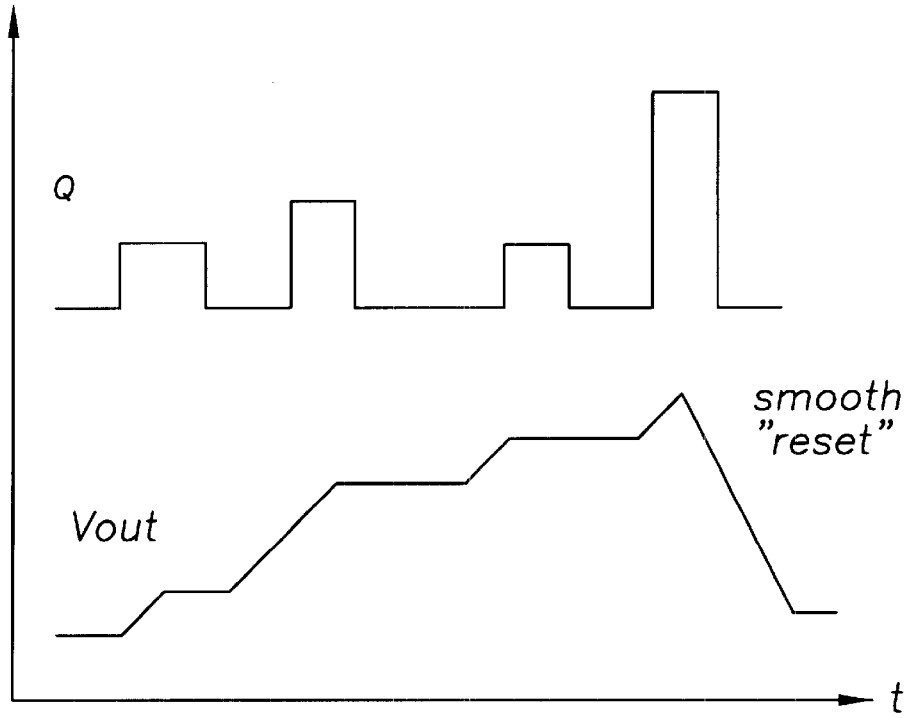
FIG. 16 is a graph showing charge detection by the integrator circuit of FIG. 3.

Now referring to FIGS. 15 and 16, the integrator circuit 24 can also be used for charge detection. For example, x-ray and particle detectors output charge pulses that are usually integrated. Whenever a conventional integrator hits a limit value as in FIG. 15, it must reset and data can be lost. Using the integrator circuit 24, the dead-time (lost data) is greatly reduced by the absence of capacitor resets as shown in FIG. 16.

Figure 17:
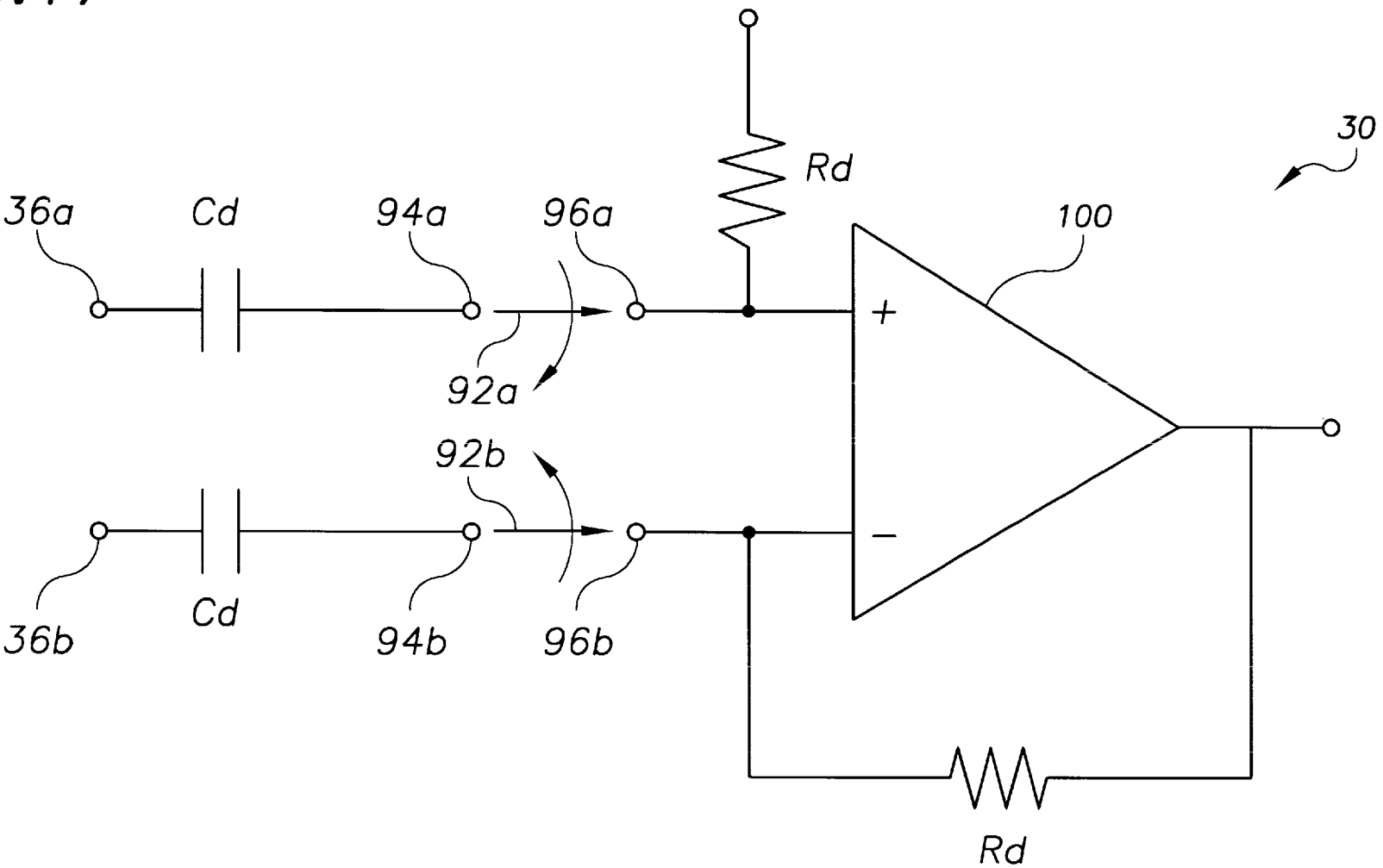
FIG. 17 is a schematic diagram of the differentiator circuit of FIG. 2.

A differentiator circuit 30, shown in FIG. 17, may be part of a chopper stabilizing circuit. The differentiator circuit 30 includes two switches 92*a–b*. The switches 92*a–b* may be any type of standard MOS (metal oxide semiconductor) switch, e.g., MAXIM 326. Each switch 92*a–b* is either in a horizontal (>1) position, e.g., switch 92*a* from a top start node 94*a* to a top end node 96*a*, or a diagonal (>2) position, e.g., switch 92*a* from the top start node 94*a* to a bottom end node 96*b*, at any given time. Each closed switch 92*a–b* provides a path for a signal at entering nodes 36*a–b* to travel to the inverting terminal or to the non-inverting terminal of an opamp 100. Input from a control circuit (not shown) determines the position of the switches 92*a–b*. If the differentiator circuit is connected to the chopper stabilizing circuit 20 (see FIG. 2), the output from the control circuit 78 provides the phase information for the switches 92*a–b*.

A number of embodiments of the invention have been described. Nevertheless, it will be understood that various modifications may be made without departing from the spirit and scope of the invention. Accordingly, other embodiments are within the scope of the following claims.

What is claimed is:

1. An integrator circuit comprising:

a first integrator; and a second integrator having an inverting terminal connected to an inverting terminal of the first integrator, having a non-inverting terminal connected to an output of the first integrator through a first capacitor, and having an output connected to a non-inverting terminal of the first integrator through a second capacitor.

2. The integrator circuit of claim 1 wherein the non-inverting terminal of the first integrator and the non-inverting terminal of the second integrator are each connected to a distinct switch in a switching circuit.

3. The integrator circuit of claim 1 wherein, in operation, the first integrator and the second integrator have voltages on their respective ones of the inverting and non-inverting terminals that are substantially equal.

4. The integrator circuit of claim 1 wherein, in operation, the first integrator and the second integrator produce output voltages that are complementary.

5. The integrator circuit of claim 1 wherein, in operation, the first integrator and the second integrator each produce an output voltage that is provided in a chemical bath on either side of a biological membrane.

6. The integrator circuit of claim 1 wherein the integrator circuit is configured to detect fluctuations of ion channels.

7. The integrator circuit of claim 1 wherein the integrator circuit is configured for charge detection.

8. The integrator circuit of claim 1 wherein each of the first and second integrators comprise an operational amplifier.

9. An integrator circuit comprising:

at least two integrators, each having an input connected to alternately receive an input current; and a plurality of integrator feedback capacitors, each integrator feedback capacitor connected to alternately charge and discharge, based on integrator input current, in a cooperating manner for continuous integrator circuit integration without integrator circuit reset.

10. The integrator circuit of claim 9 wherein the plurality of integrator feedback capacitors comprises two feedback capacitors, each feedback capacitor associated with a corresponding one of the two integrators.

11. An integrator circuit comprising:

a first integrator, having a non-inverting terminal; and a second integrator, having a non-inverting terminal, the non-inverting terminal of the first integrator and the non-inverting terminal of the second integrator each being connected to an input node to alternately receive an input current for continuous integrator circuit integration without integrator circuit reset.

12. The integrator circuit of claim 11 wherein the non-inverting terminal of the first integrator and the non-inverting terminal of the second integrator are each connected to a distinct switch in a switching circuit to alternately receive an input current based on switch position.

13. The integrator circuit of claim 12 wherein each distinct switch is connected to alternate a voltage bias between the first and second integrators, based on switch position, as the input current is alternately received by the two integrators.

14. The integrator circuit of claim 12 wherein the input current comprises a current from a load, and wherein the connection of the non-inverting terminal of the first integrator to a distinct switch and the connection of the non-inverting terminal of the second integrator to a distinct switch are each configured with respect to an input node to preserve a uniform load voltage bias and a uniform input current orientation through the load for any switch position.

15. The integrator circuit of claim 12 wherein the input current comprises a current from a load, and wherein the connection of the non-inverting terminal of the first integrator to a distinct switch and the connection of the non-inverting terminal of the second integrator to a distinct switch are each configured with respect to an integrator circuit input node to maintain a constant flow of load input current for any switch position.

16. The integrator circuit of claim 11 wherein each of the first and second integrators includes a corresponding feedback capacitor, the connection of the non-inverting terminal of the first integrator and the non-inverting terminal of the second integrator each to an input node being configured to charge one of the feedback capacitors while discharging the other feedback capacitor.

17. The integrator circuit of claim 11 further comprising an output node connected to produce an integrator output signal comprising a continuous flow of two complementary voltages.

* * * * *